US005984741A

United States Patent [19]

Nakamura et al.

[11] Patent Number: 5,984,741

[45] Date of Patent: Nov. 16, 1999

[54] HYDRAULIC TILT AND TRIM CONTROL FOR MARINE PROPULSION

[75] Inventors: Daisuke Nakamura, Hamamatsu; Masahiko Iida, Kakegawa, both of Japan

[73] Assignee: Sanshin Kogyo Kabushiki Kaisha, Hamamatsu, Japan

[21] Appl. No.: 08/867,172

[22] Filed: Jun. 2, 1997

[30] Foreign Application Priority Data

May 31, 1996 [JP] Japan ..... 8-160729

[51] Int. Cl.[6] ..... B63H 20/08

[52] U.S. Cl. ..... 440/61; 440/56

[58] Field of Search ..... 440/56, 61

[56] References Cited

U.S. PATENT DOCUMENTS 4,308,018 12/1981 Nakamura et al. ..... 440/61

5,720,637 2/1998 Nakamura ..... 440/61

*Primary Examiner*—Sherman Basinger

*Attorney, Agent, or Firm*—Knobbe, Martens, Olson & Bear LLP

[57] ABSTRACT

A hydraulic arrangement for controlling the tilt and trim of an outboard drive. The hydraulic arrangement comprises a single cylinder assembly having a single bore inside wherein two separate pistons are supported for reciprocation and sealed to the cylinder with piston seals. The lower piston is connected to a valve mechanism that selectively opens or closes a cylinder relief hole depending upon the position of the piston within the cylinder. The valve mechanism operates so that the piston seals never contact the relief hole to prevent premature failure of the piston seals.

8 Claims, 9 Drawing Sheets

HYDRAULIC TILT AND TRIM CONTROL FOR MARINE PROPULSION

BACKGROUND OF THE INVENTION

This invention relates to a hydraulic tilt and trim mechanism for a marine propulsion unit and more particularly, to an improved hydraulic tilt and trim arrangement for such unit.

It is a well known practice in marine propulsion units, whether they are outboard motors or the outboard drive portion of an inboard-outboard drive, to mount the propulsion unit so that it can be adjusted for tilt and trim. These units normally incorporate a hydraulic motor that affects at least the trim and, at times, the tilt operation of the outboard motor. For convenience, the employment of hydraulic arrangements for moving the outboard drive both through the trim adjustment and for tilting the outboard drive up out of the water has been proposed. Normally, a reversible electric motor drives a reversible fluid pump that selectively pressurizes or depressurizes the hydraulic motor for effecting these movements.

The fluid pump sends pressurized fluid into various ports of a closed cylinder with a piston slidably mounted therein. The piston is sealed to the cylinder bore with a conventional seal, such as an O-ring, to prevent flow from between the separate chambers created by the piston within the cylinder. By pressurizing the chamber on one side of the piston and depressuring the other side the piston will move within the cylinder. Attached to the piston is a piston arm which is connected to the propulsion unit. The other end of the cylinder is attached to the transom of a watercraft. Thus, by pressurizing the chambers the operator of the boat changes the position of the piston thereby changing the relative angle of the propulsion unit to the watercraft.

The pressures in the cylinder chambers vary greatly depending on whether the propulsion unit is operating in the trim range or in the tilt range. In the tilt up range, usually associated with tilting the propulsion unit out of the water, the pump generates a relatively low pressure in the chambers because the only load on the cylinder is the weight of the propulsion unit. During the trim down mode the weight of the engine applies the requisite force to tilt down the engine.

Conversely, to trim up the motor the pump must generate far greater pressure because of the load placed on the unit by the propulsion unit. The increase in load is caused by the force created by the propeller of the propulsion unit moving the watercraft through the water. The relatively greater force created by the propulsion unit is directly transmitted into larger forces on the tilt and trim mechanism resulting in higher pressures required in the internal cylinders to trim up the motor in a running condition. In the trim down mode, the pump is not required to generate as much pressure as the driving force of the propulsion unit creates the trim down force.

Because of the need to relieve the pressure in the cylinder from the high pressure required in the trim up mode to the low pressure required in the tilt up mode a pressure relief device is needed. One suggested proposal for reducing the pressure in the tilt and trim cylinder during the transition between trim and tilt mode is shown in FIG. 9. This diagram shows a conventional hydraulic circuit and the piston design of a conventionally designed tilt and trim mechanism. The cylinder 19 contains two pistons: an upper piston 46 and a lower piston 45. The upper piston 46 is connected to the piston arm 23. The lower piston 45 abuts the upper piston 46. The cylinder has three openings for fluid to flow enter the internal cylinder chambers which are labeled as follows: upper cylinder chamber port 49, lower cylinder chamber port 48 and relief port 52.

In the trim mode, the lower edge of the lower piston is beneath the relief port 52. Thus, fluid can only enter or exit the lower cylinder chamber through port 48 in the trim mode. As stated above, during the trim up mode there is a relatively large pressure in cylinder chambers. When the lower edge of the lower piston rises above relief port 52 the system is in the tilt mode and the pressure required to trim the propulsion unit is no longer needed. Thus, the pressure is relieved by the fluid exiting the lower cylinder through the relief port 52.

To prevent fluid from seeping around the pistons from one chamber to another the piston are fitted with seals. The seals are typically O-rings made of a rubber compound. The O-rings provide adequate sealing as long as they are free from cuts or nicks. If they are damaged the fluid can pass around the piston preventing the tilt and trim mechanism from functioning properly.

One problem with the piston design, as shown in FIG. 9, is that the O-ring on the lower cylinder passes the relief port in the normal course of operation. Because the cylinder is typically made of metal and the relief port is typically a hole bored through the side wall of the cylinder the inner surface of the lower cylinder chamber in the area of the relief port may be rough. This rough inner surface may damage the O-ring seal of the piston resulting in durability problems.

It is therefore a principal object of this invention to provide an improved hydraulic trim control for a marine propulsion unit. It is a further objective of this invention to create a hydraulic trim and tilt control for a marine propulsion unit wherein the system is durable.

SUMMARY OF THE INVENTION

This invention is adapted to be embodied in a hydraulic tilt mechanism for a marine outboard drive comprised of a hydraulic motor having a cylinder that is adapted to be affixed to one of the members of the outboard drive. The cylinder defines a cylinder bore. At least one piston is reciprocal in the cylinder bore and defines at least one fluid chamber therein. A piston rod is attached to the piston and extends through one end of the cylinder so it can be connected to another member of the outboard drive for effecting relative trim movement of the members upon pressurization of the fluid chamber. A seal is placed around the piston to seal the piston to the wall of the cylinder. The internal chamber is to incorporate a relief port for the release of pressurized fluid. The relief port is opened or closed by a valve mechanism depending on the position of the piston within the cylinder. The valve mechanism opens the relief port when the propulsion unit is in the tilt range and closes the valve when the unit is in the trim range. The valve mechanism of the present invention operates in a manner that prevents the piston seal from contacting the sharp surface of the relief port thereby eliminating the durability problems of the previous designs.

DETAILED DESCRIPTION OF THE PREFERRED EMBODIMENTS OF THE INVENTION

Figure 1:
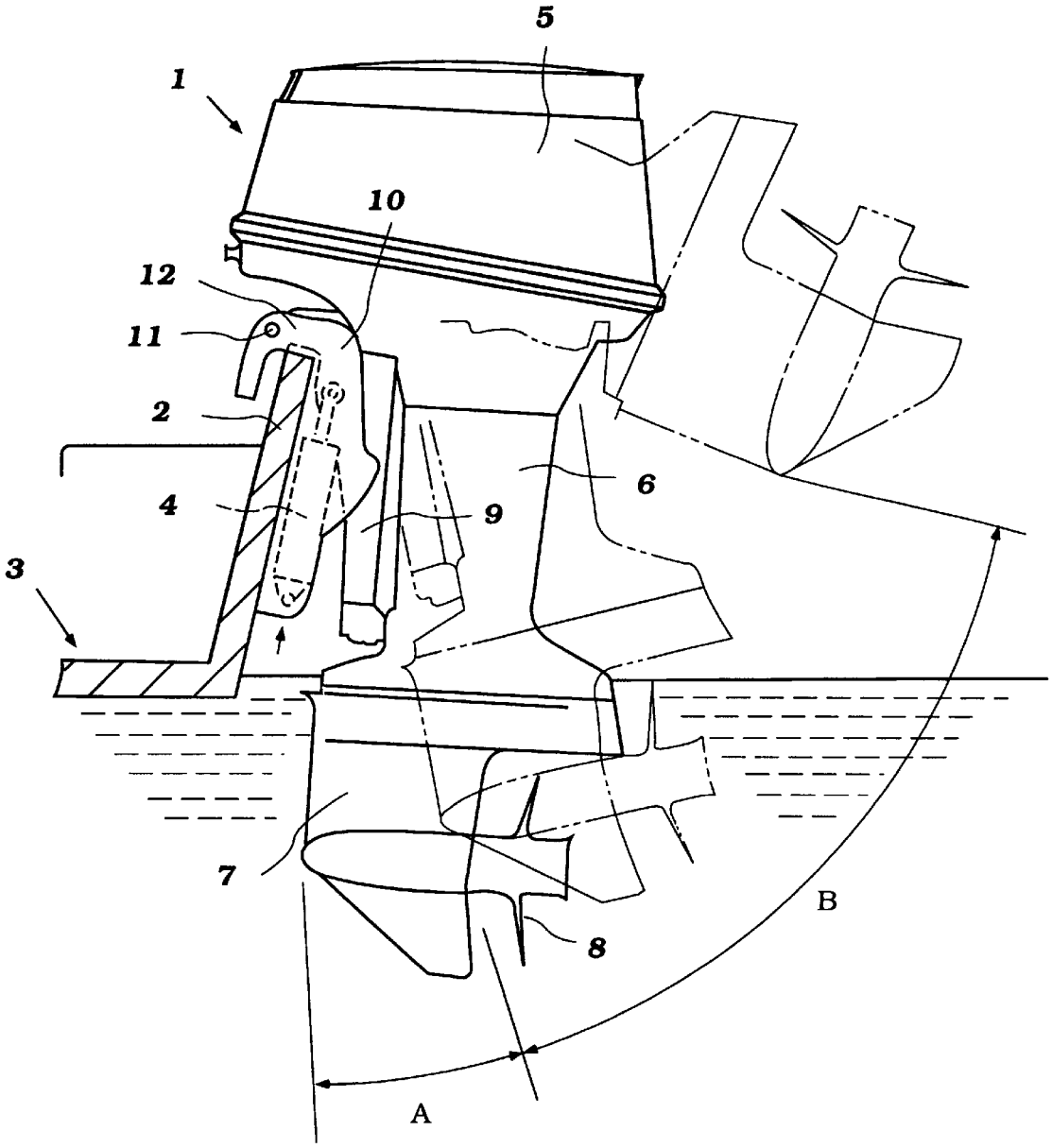
FIG. 1 is a side elevational view of an outboard motor constructed in accordance with an embodiment of the invention as attached to the transom of an associated watercraft, drawn partially and in section, the fully trimmed down position is shown in solid line while the fully trimmed up position and the tilted up out-of-the-water position are shown in phantom line.

Referring now in detail to FIGS. 1–9, which illustrate a preferred embodiment of the invention, and initially to FIG. 1, an outboard motor constructed in accordance with the preferred embodiment of the invention is identified generally by the reference numeral 1. The outboard motor 1 is shown as attached to a transom 2 of an associated watercraft 3 that is shown partially and in section. The hydraulic tilt and trim mechanism constructed in accordance with this embodiment of the invention is identified generally by the reference numeral 4 and is shown in more detail in FIGS. 2–8. Basically, the attachment of the hydraulic tilt and trim mechanism 4 to the associated watercraft 3 and its relationship with the outboard motor 1 is the same as the prior art type of devices. This connection will be described briefly below.

Also, although the invention is described as it functions with the outboard motor 1, it should be readily apparent that the invention is capable of use with other types of outboard drives, such as the outboard drive portion of an inboard/outboard drive. Because of the nature of the invention, however, it is particular useful with outboard drive units of small and medium size. This does not mean that the facets of the invention cannot be used with larger displacement units and it is believed that such usage will be readily obvious to those skilled in the art.

The outboard motor 1 includes a power head 5 which is comprised of a powering internal combustion engine and a surrounding protective cowling. As is typical with outboard motor design, the engine of the power head 5 is mounted so that its output shaft rotates about a vertically extending axis and drives the drive shaft that is journaled within the drive shaft housing 6. None of the internal components of the outboard motor 1 are illustrated because it will be obvious to those skilled in the art how the invention can be employed with any conventional type of structure.

The drive shaft which extends through the drive shaft housing 6 extending into the lower unit 7. There, the drive shaft drives a propulsion device, such as a propeller 8, through a conventional forward/neutral/reverse transmission.

A steering shaft that is not shown is attached to the drive shaft housing 6 and is supported for steering movement within a swivel bracket 9 in a known manner. The swivel bracket 9 has a forward extending portion 10 that is connected of a pivot pin 11 to a clamping bracket 12. The clamping bracket 12 is adapted to be detachable and is affixed to the transom 2 in a well-known manner.

The pivotal connection 11 between the clamping bracket 12 and the swivel bracket 9 permits the outboard motor 1 to be moved through a trim adjusted range, indicated at "A" in FIG. 1. In FIG. 1, the fully trimmed down position is shown in solid lines and the fully trimmed up position is shown in phantom lines. Additionally, the outboard motor 1 may be swung through a remaining arc "B" to a tilted up out-of-the-water position about the pivot pin 11, as also shown in a phantom line view. The hydraulic tilt and trim mechanism 4 operates to effect these movements and other movements, as will become apparent.

Figure 2:
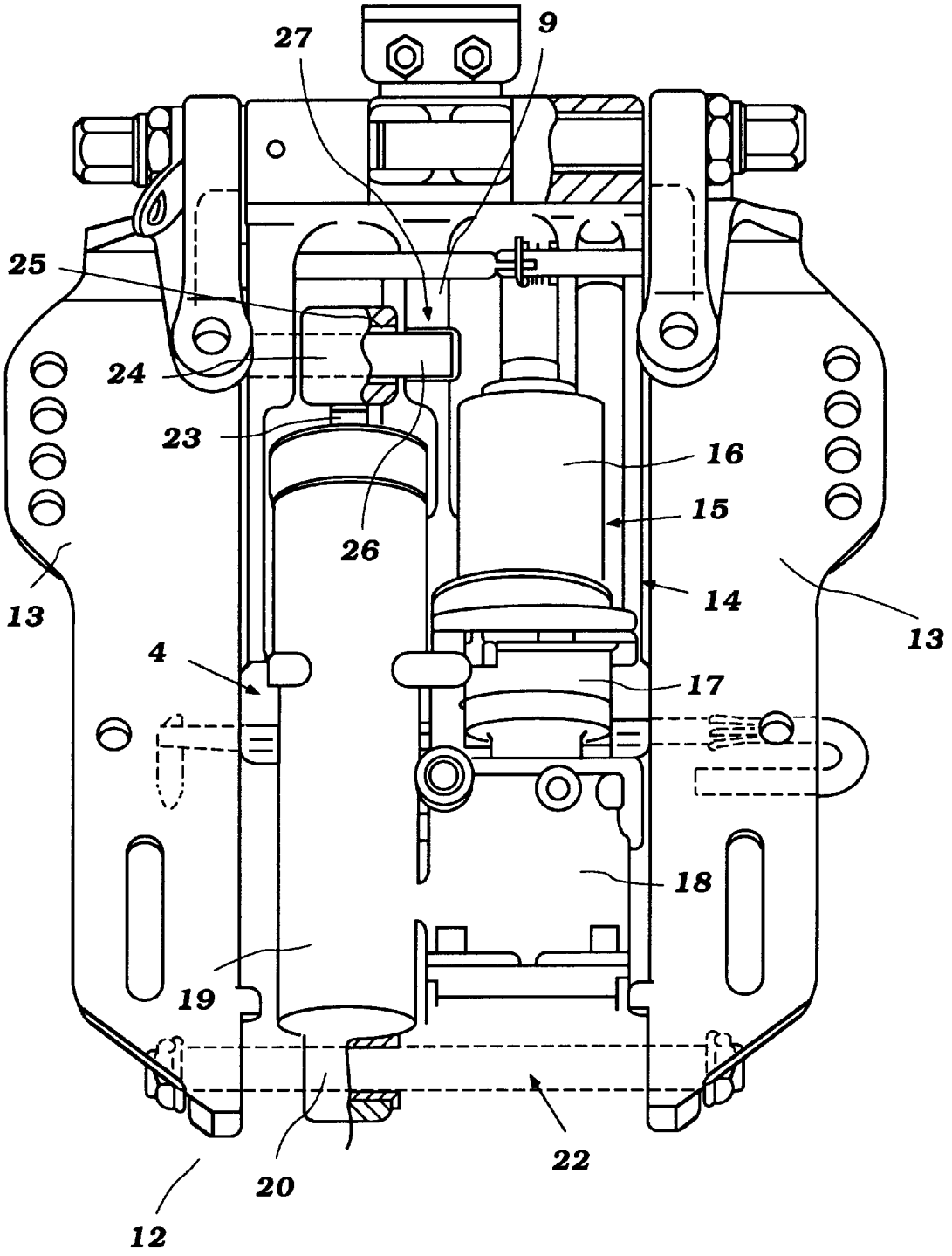
FIG. 2 is an enlarged front elevational view of the hydraulic tilt and trim adjustment mechanism.

The mechanism 4 will now be described by additional reference to FIGS. 2 through 4. It will be seen that the clamping bracket 12 actually comprises a pair of spaced-apart side portions 13 that are mounted on the rear of the transom 2 with the swivel bracket 9 interposed between the two side portions. The hydraulic tilt and trim mechanism 4 is nested between the bracket 13 to create a compact assembly.

The tilt and trim mechanism 4 is comprised of the actual hydraulic motor assembly, indicated generally by the reference numeral 14. The hydraulic motor assembly is located adjacent to the powering assembly and thus is an integral part of the powering assembly 15. At the upper end, the powering assembly 15 includes a reversible electric motor 16. A reversible hydraulic pump 28 is disposed below the motor 16. A fluid reservoir 18 is disposed beneath the pump 28 and contains fluid for the system. In addition, a suitable valve assembly may be incorporated into the pump 28 and reservoir 18 to provide the normal pressure relief functions.

Additionally, the pump 28 is equipped with a pair of outlet ports that communicate with inlet ports formed in the hydraulic tilt and trim mechanism 4. It should be noted that the outer housings of the units 4 and 14 may be common or, they may comprise separate pieces that are affixed to each other. By having interfitting ports, the necessity for providing external conduits is avoided and the construction is more compact.

Continuing to refer primarily to the external construction, the hydraulic motor 14 includes a cylinder housing 19 having a trunnion portion 20 with a bore 21 that receives a pin 22 to provide a pivotal connection to the clamping bracket 12, and specifically to the side plates 13. In addition, a piston rod 23 has a trunnion 24 with a bore 25. This piston rod bore 25 receives a further pivot pin 26 that provides a pivotal connection to a bore 27 formed in a portion of the swivel bracket 9 to interpose the hydraulic unit 14 therebetween for the tilt and trim movement. The tilt and trim movement will now be described by reference primarily to FIGS. 3–8, so as to permit those skilled in the art to understand the principles of operation and the utility of the overall construction.

Figure 3:
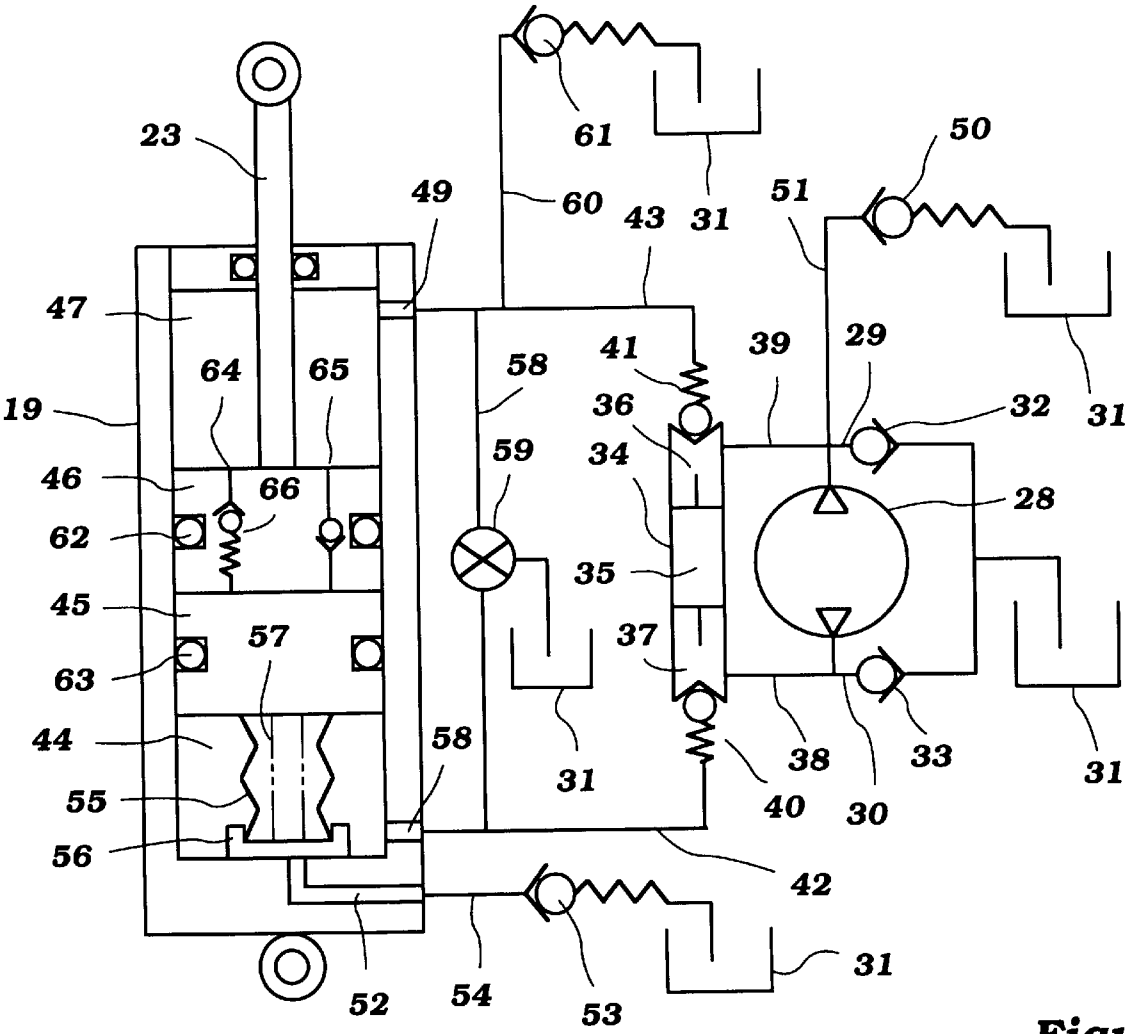
FIG. 3 is a hydraulic schematic of the present invention.

The hydraulic system of the embodiments, shown schematically in FIG. 3, includes a reversible, positive displacement pump 28 which is driven by a reversible electric motor which is not shown in this Figure. The pump 28 is provided with a pair of inlet lines 29 and 30 that extend from a sump 31 and in which respective non-return check valves 32 and 33 are provided. A shuttle valve assembly, indicated generally by the reference numeral 34, is provided downstream of the pump 28 and includes a shuttle piston 35 that divides the interior of the shuttle valve into first and second chambers 36 and 37. Pressurized fluid may be delivered from the pump 28 to the chamber 37 through a pressure line 38 or returned by this same line. In a like manner, the chamber 36 communicates with the opposite side of the pump 28 through the conduit 39.

The check valve 40 is provided outside of the chamber 37. In a similar manner, the check valve 41 controls the flow from the chamber 36. The shuttle valve 35 has outwardly extending pin projections that are adapted to engage the balls of the check valves 40 or 41 to open these check valves, as will become apparent.

The pressure line 42 extends from the shuttle valve chamber 37 to the lower side of the lower cylinder chamber 44 beneath lower piston through cylinder port 48. A line 43 communicates the shuttle valve chamber 36 with the tilt and trim cylinder assembly 4 on a side above the upper piston 46 and in communication with the upper cylinder chamber 47 through cylinder port 49.

The pump relief valve 50 is provided in the line 51 that communicates the junction of the lines 29 and 39 with the sump 31 so as to provide relief. The relief function will be described below. The pressure relief valve of the check valve type 53 is provided from lower cylinder relief port 52 communicating with the line 54 and with the sump 31. The valve mechanism 55 secures valve end gate 56 against the base of the lower cylinder chamber 44 thereby blocking fluid from exiting the lower cylinder chamber 44 through the port 52. One side of the valve mechanism 55 is attached to the side of the lower piston 45 contacting the lower cylinder chamber 44. The opposing end of the valve 55 is attached to the valve gate 56. In between the end of valve mechanism 55 is the coil spring 57 extending the valve mechanism 55.

In order to provide manual tilt and trim adjustment, the line 58 communicates the upper and lower piston chambers 47 and 44 with each other. The manually operated valve 59 is provided in the line 58 for either opening or closing this communication under manual operation. The manual valve 59 also provides communication with the sump 31.

A high pressure relief mechanism for the upper cylinder chamber 47 is provided for through the port 49 into the line 43 then to the line 60. The relief line is metered by the pressure check valve 61. When the pressure in the line 60 is above a predetermined pressure, the valve 60 will open and allow fluid to pass into the sump 31.

Both the upper piston 46 and the lower piston 45 are fitted with O-rings 62 and 63 respectively. The O-rings provide a seal between the piston 46 and the internal bore of the cylinder housing 19 and between the piston 45 of the same housing 19.

Figure 6C:
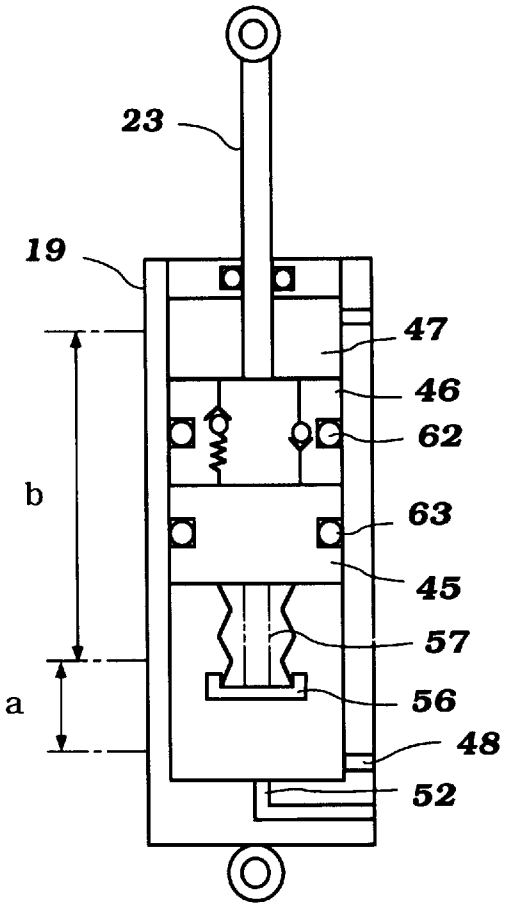
FIGS. 6A, 6B and 6C show the embodiment of the invention in the fully trimmed down position, to the fully trimmed up position to the titled up position respectively.
Figure 6B:
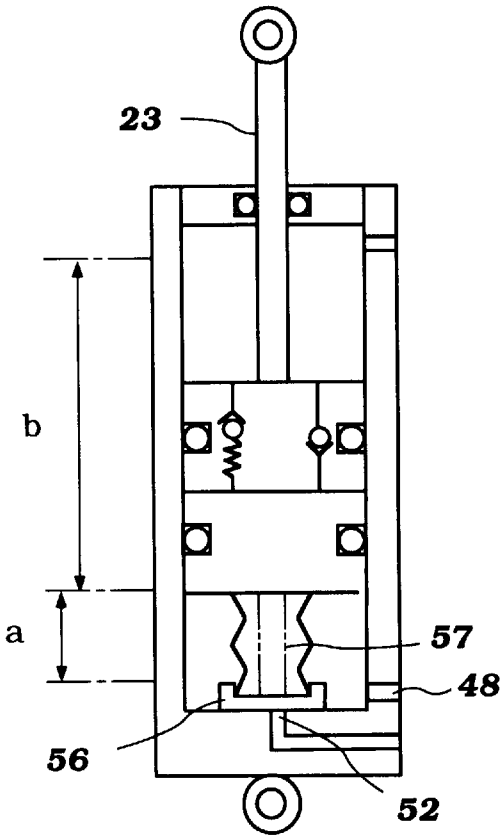
Figure 6A:
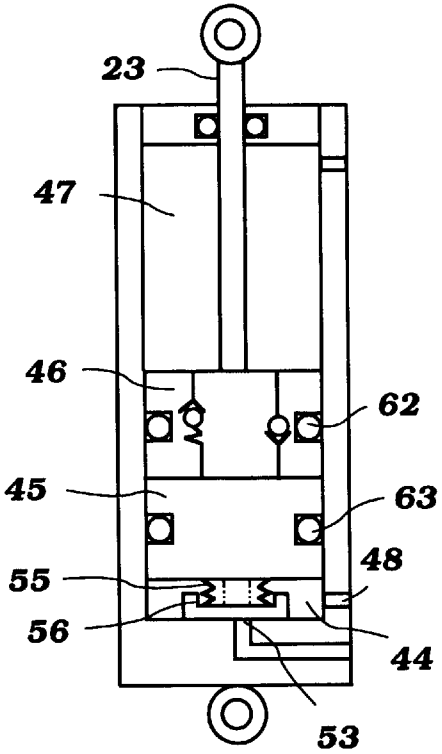

FIGS. 6A and 6B show the condition of the tilt and trim mechanism during the full trim down and full trim up modes, respectively. FIG. 6C shows the mechanism 4 in the tilt region. Assuming that the motor 1 is operating in the trim range (defined as "A" in FIG. 1) and that the manual valve 59 is closed, if the operator desires to provide a trim up adjustment, through a suitable control, he operates the motor 16 to drive the pump 28 in a direction that will pressurized the line 38 while the line 39 acts as a return line (in FIG. 3). When the line 38 is pressurized, the pressure in the chamber 37 will exceed the pressure in the chamber 36 and the shuttle piston 35 of the shuttle valve assembly 34 will be forced toward the valve 41 from its previously neutral position. When the shuttle piston 35 is shifted toward the valve 41, its projection will unseat the ball check valve 41 and open communication between the shuttle valve chamber 36 and the line 43.

Pressurization of the chamber 37 causes the ball check valve 40 to open. Thus, the line 42 will be pressurized so that the lower cylinder chamber 44 will be pressurized, and the lower piston 45 is thereby caused to move in an upward direction toward the upper cylinder chamber 47. The force created by the upward movement of the lower piston 45 is also imparted to the upper piston 46, as the two pistons are in contact along their adjacent faces during this operation. Accordingly, the motor 1 is trimmed up by way of the piston rod 23. As the upper piston 46 moves upward, in conjunction with the lower piston 45, the hydraulic fluid in the upper cylinder chamber 47 is discharged through the port 49 and into line the 43 for return to the input side of the pump 28 through the shuttle piston chambers 36 and into the line 39.

To tilt the motor 1 up, as shown as the motor I position in the "B" range on FIG. 1, the pump 28 is continued to be operated as in the trim up mode explained above. The pressurized hydraulic fluid continues to flow through the line 42 and into the lower cylinder chamber 44. This consequently places a force on the lower piston 45 and the upper piston 46. Accordingly, the upper piston 46 and the piston rod 23 are moved toward the end of the cylinder 19 contacting the rod 23. The tilt range is marked by the complete extension of the valve mechanism 55 and the unseating of the valve end plate 56 from the relief port 52. This allows the highly pressurized fluid in the lower cylinder chamber 44 to exit through the relief port 52 into the line 54 through pressure the relief valve 53 and finally into the sump 31. Once the high pressure of trim mode is relieved, the valve 53 will close. Thus, fluid will continue to flow into the lower cylinder chamber 44 and move both the pistons 45 and 46 toward the end of the cylinder 19 contacting the piston rod 23 and tilting up the motor 1.

During the tilt up operation the fluid of the upper cylinder chamber 47 will exit the chamber through the port 49 into the line 43 and back through the shuttle valve 34 and into the pump 28. If the pressure is above a predetermined amount it can be released through the port 49 into the line 60 through the pressure relief valve 61 and returned to the sump 31.

When the motor 1 is tilted all of the way up, there will be a rise in the pressure in the line 60 and the relief valve 61 will open so as to return fluid to the sump 31. At this point, the operator should then discontinue operation of the pump 28. The motor 1 will be retained in its tilted up position by the hydraulic fluid contained within the lower cylinder chamber 44.

The tilt and trim down operation will now be described by reference to FIG. 3. Assuming that the motor 1 is in a tilted up condition, the upper piston 47 will be near the upper end of the bore of the cylinder 19. If the operator decides to tilt the motor down, the electric motor is energized so as to drive the pump 28 in a direction that pressurizes the line 39 and causes the line 38 to function as a pump return line. The pressure in the line 39 will also be created by the weight of the motor 1 during the tilt down operation and by the force of the motor 1 propelling the watercraft through the water in the trim down operation.

When the line 39 is pressurized, the pressure in the chamber 36 of the shuttle valve assembly 34 will shift the shuttle valve toward the line 42 thereby unseating the check valve 40. The pressure in the chamber 36 is also sufficient to unseat the check valve 41 thus allowing fluid to flow from the chamber 36 and thereby pressurizing the line 43. Accordingly, pressure will be exerted in the upper cylinder chamber 47 above the tilt piston 46. The tilt piston 46 will be forced downward toward the lower cylinder chamber 44 to tilt down the motor 1. During downward movement of the upper piston 46 and the lower piston 45 a quantity of fluid is expelled from within the lower cylinder chamber 44 through the port 48 to the line 42 and passes through the opened valve 40 into the chamber 37 and to the pump return line 38. When the desired position is reached, the operator again stops the motor and the propulsion unit 1 will be retained in the desired position by the lockage of hydraulic fluid in the cylinder chambers.

The end of the fully tilted down position is marked by the valve gate 56 covering relief port 52. When the valve gate 56 completely covers relief port 52 the motor 1 is in the trimmed down position. To trim propulsion unit 1 down the hydraulic fluid is delivered to the upper cylinder chamber 47 (as discussed above with reference to the tilt down operation) the hydraulic fluid in the lower cylinder chamber 44 is discharged through the line 42.

If the motor continues to run in the tilt down condition once both pistons have reached the limits of their travel, the pressure in the line 51 will rise abruptly and the relief valve 50 will open causing fluid pressurized by the pump 28 to be returned to the sump 31.

If at any time it is desired to manually tilt the motor 1 up, the manually operated valve 59 may be opened to communication between the chambers 44 and 47 through the line 58. When the valve 59 is opened, an upward force on the motor 1 will cause the piston rod 23 to move upwardly and displace fluid through the line 58 to the chamber 44. Closure of the valve 59 will then lock the motor 1 in its up position. In a like manner, opening of the valve 59 can permit the motor 1 again to be lowered manually under its own weight which will effectively displace fluid from the chamber 44 through the line 58 and into the chamber 47. Make up fluid can be obtained from, or excess fluid delivered to, the sump 31 with regard to any of the cylinder chamber regions as necessary during either of these operations.

In addition to providing tilting action, the tilt and trim mechanism 4, and the piston 46 and the piston rod 23 provide a hydraulic damping operation. The damping operation allows the motor 1 to pop-up if it strikes an underwater object as to prevent damage. The passage 64 is formed in the piston 46 for permitting flow from the upper chamber 47, above the upper piston 46, to a region between the pistons 46 and 45. The passage includes the pressure responsive absorber valve 66 of the check type that permits flow in response to a predetermined force tending to cause the motor 1 to tilt or pop up. The amount of the force necessary to open the valve 66 is set, as is well known, to the desired value. Return flow from the region below the upper piston 46 to the upper chamber 47 is permitted by opening through the passage of 65. During the pop-up operation of the motor 1 the lower piston 45 remains stationary. By remaining in one place, the lower piston 45 serves as a memory device for the tilt and trim mechanism 4 so that the upper piston 46 will return to the same trim setting as before it struck the underwater object.

Figure 9:
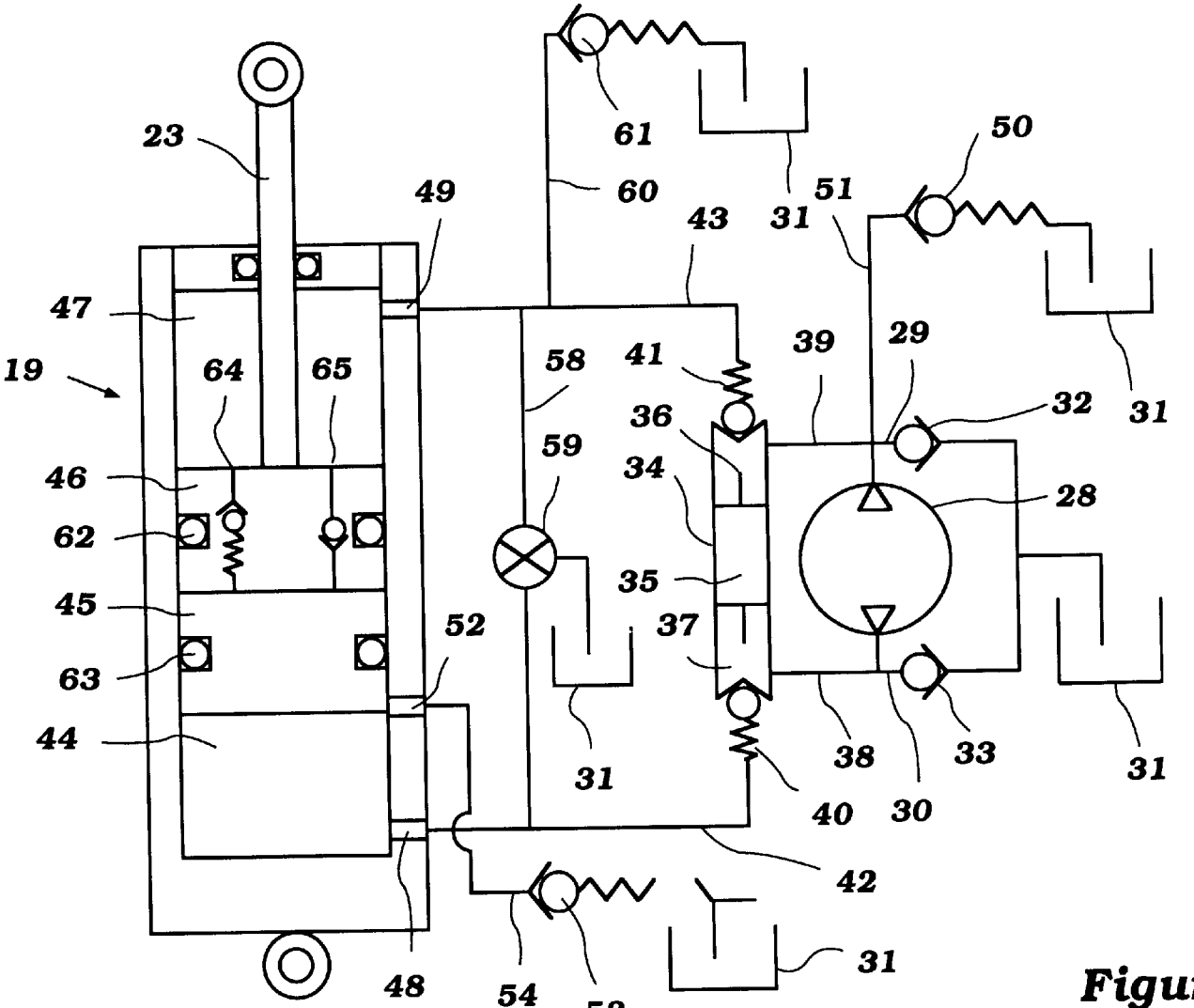
Figure 9 Prior Art
FIG. 9 is a hydraulic schematic of the prior art.

Previous attempts to create a mechanical valve means for releasing the pressure in the lower cylinder 44 are shown in FIG. 9. In FIG. 9, the hydraulic schematic is equivalent to that described above except for the location of the relief port 52 for the lower cylinder chamber 44. In this design shown in FIG. 9, fluid would leave the lower cylinder chamber 44 through the relief port 52 when the lower piston 45 was not in a position to block the entrance to the port 52. The location of the port 52 on the side chamber wall of the cylinder 19 was located to correspond to the tilt range of motor 1. Thus, when the motor 1 was in the tilt range the position of lower piston 45 would allow passage of fluid into the port 52 relieving the lower cylinder chamber of the pressure generated in the trim mode. If the motor 1 was trimmed down, the piston 45 would move toward the end of cylinder 19 away from piston rod 23 in the manner described in the previous trim down mode. In the fully trimmed position of this configuration the piston seal 63 must travel over the port 52.

As explained above, the piston seal 63 is typically an O-ring made of a rubber material as is generally known in the art. When the piston seal 63 comes into contact port 52 it will gradually wear down. After continued used the piston seal 63 will become damaged and the seal will lose its integrity allowing fluid to pass around the seal 63 and into the upper cylinder chamber 47. The present invention (as shown with the hydraulic schematic in FIG. 3 and in detailed embodiments in FIGS. 4, 5, 7 and 8) shows how the piston seal 63 never contacts a relief port thereby increasing the durability of the design.

Figure 4:
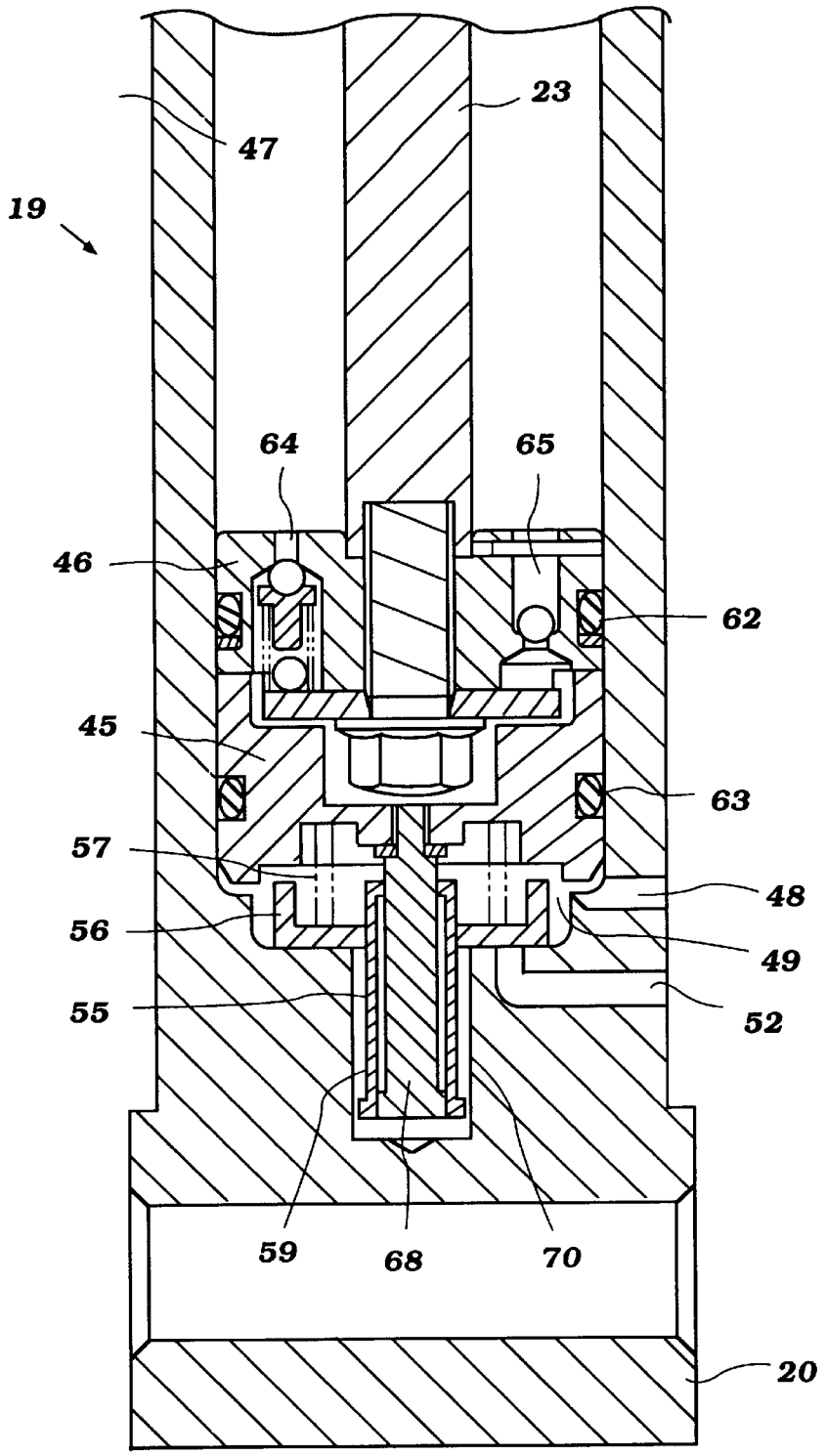
FIG. 4 is a broken cross-sectional view taken through the tilt and trim cylinder in the fully trimmed down position in accordance with a first embodiment of the invention.

The outer cylinder 19 of the tilt and trim mechanism 4 of a first embodiment of the invention is shown in a broken cross-sectional view in FIG. 4 when the motor 1 is in a fully trimmed down position. In the trimmed down position the valve mechanism 55 is in a fully collapsed position. The hydraulics necessary to achieve this position are explained in full above, however, a brief explanation will illuminate the present invention: In a fully trimmed down position the upper cylinder chamber 47 is pressurized with fluid thereby moving both the pistons 46 and 45 toward the end of the cylinder 19 opposite the end of cylinder 19 contacting the piston rod 23. The lower piston 45 acts on the coil spring 57 thereby placing a downward force on the valve end gate 56 sealing the port 52.

In this position the inner sleeve 68 of the valve mechanism 55 is at the end of its stroke within the outer sleeve 69 and both are located in the valve storage 70. The inner sleeve 68 is threaded on the end nearest the lower piston 45. The lower piston 45 contains internal threads designed to accept the threaded end of the inner sleeve 68. The inner sleeve 68 also contains a shoulder to engage the inner ledge of the outer sleeve 69. The outer sleeve 69 also contains a shoulder to engage the valve gate 56. The coil spring 57 keeps the valve gate away from the lower piston 45 and seals the port 52 with the valve end gate 56.

Figure 5:
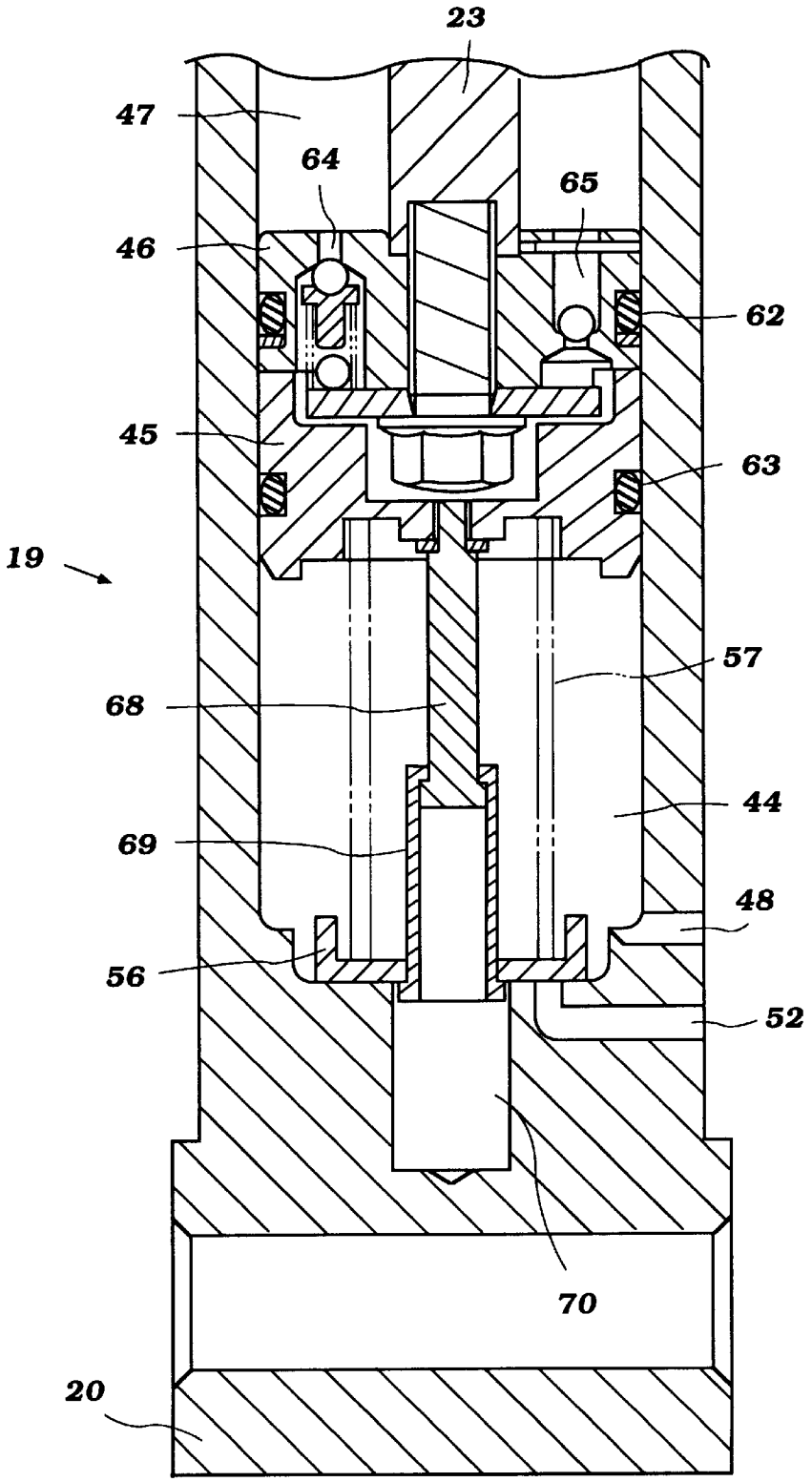
FIG. 5 is a broken cross-sectional view taken through the tilt and trim cylinder of FIG. 4 in the fully trimmed up position.

When the motor 1 is being trimmed up fluid will enter the lower cylinder chamber 44 through port 48 as described above thereby moving the lower piston 45 and the upper piston 46 toward the end of cylinder 19 contacting the piston rod 23. The inner sleeve 68 will move with the lower piston 45 until the shoulder on the end of inner sleeve 45 contacts the inner ledge of outer sleeve 69. At this time, the lower piston will pull both the inner sleeve 68 and the outer sleeve 69 until the shoulder of outer sleeve 69 contacts valve end gate 56. During this entire process the coil spring is forcing the valve end gate 56 down thereby sealing the port 52. The fully trimmed position of the first embodiment of the invention is shown in FIG. 5. The valve mechanism 55 is fully extended and the coil spring 47 is forcing the end gate 56 to seal the port 52.

FIG. 6 illustrates the invention in the fully trimmed down position 6A, the fully trimmed up position in 6B and the tilt region in 6C. The "a" and "b" in FIGS. 6A and 6B refer to the trim and tilt range respectively. In FIG. 6A the motor 1 is in a fully trimmed down position as shown in solid line in FIG. 1. The lower piston 45 is in its lowest position and the valve mechanism 55 has the port 52 closed. In FIG. 6B the motor 1 is in the fully trimmed up position and the port 52 is still sealed. In FIG. 6C the valve mechanism 55 is fully extended but the lower piston 45 is in the tilt range "b" and relief port 52 is open. FIG. 6 demonstrates how the valve mechanism provides a mechanical solution for opening the relief port 52 at the beginning of the tilt range without exposing the piston seals 63 or 62 to the potentially damaging ports.

Figure 7:
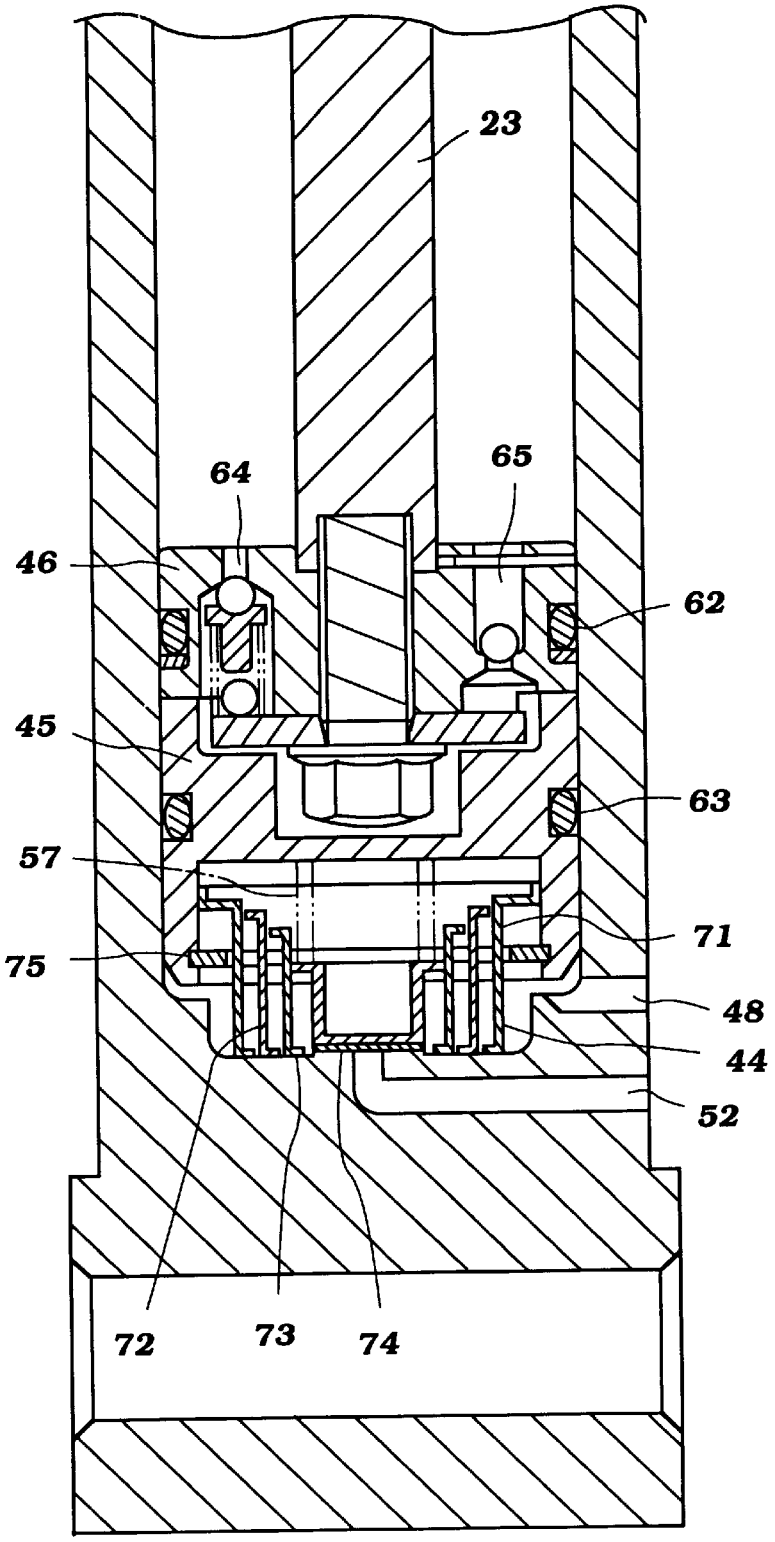
FIG. 7 is a broken cross sectional view, taken through the tilt and trim cylinder in the fully trimmed down position in accordance with a second embodiment of the invention.
Figure 8:
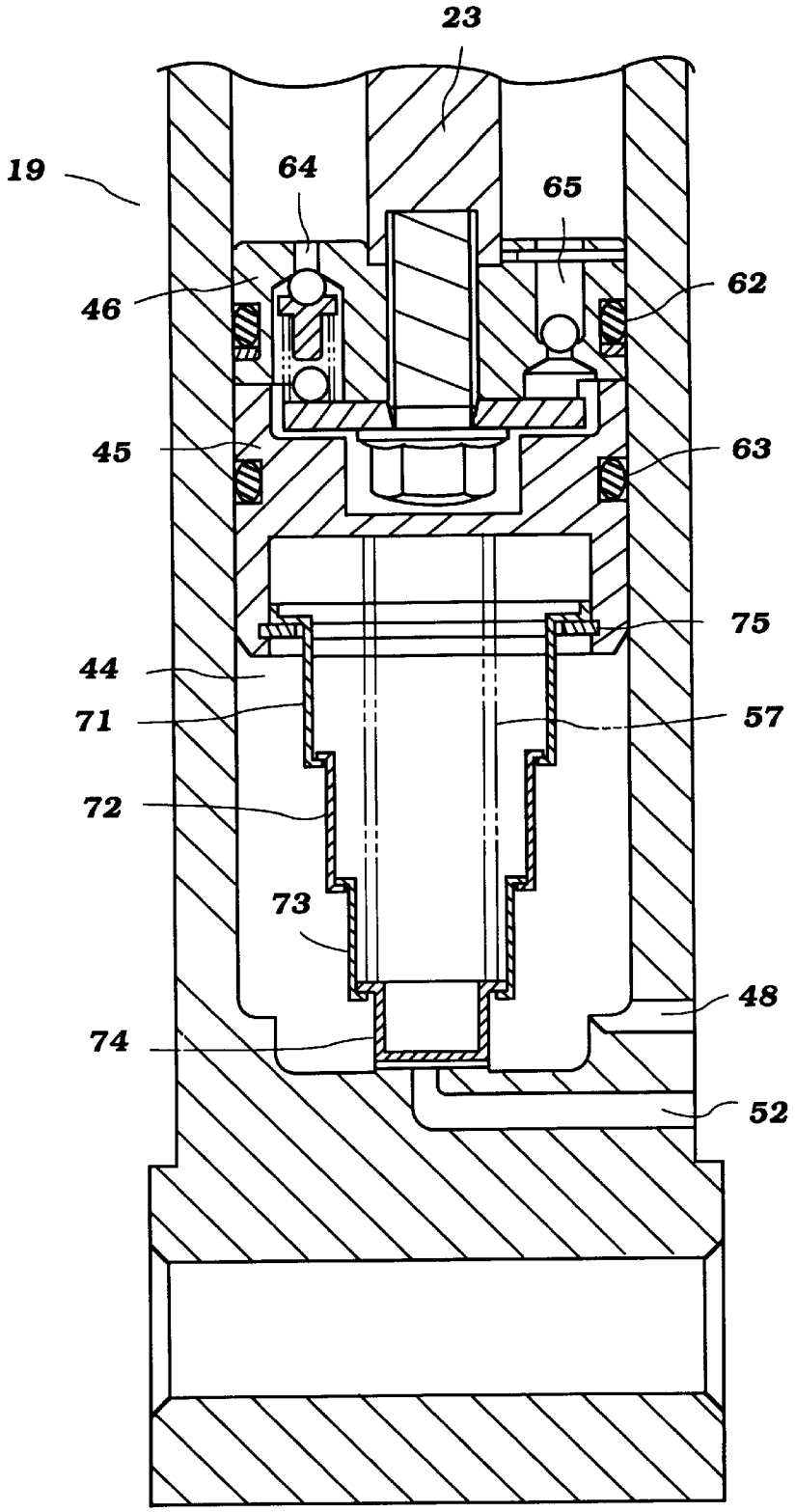
FIG. 8 is a broken cross sectional view, taken through the tilt and trim cylinder of FIG. 7 in fully trimmed up position.

FIG. 7 shows a second embodiment of the valve mechanism 55 in the fully trimmed down position. In the second embodiment the valve mechanism 55 is comprised of the outer sleeve 71 with a shoulder that abuts the retaining ring 75 and an inner ledge which abuts the outer shoulder of the mid sleeve 72. Also, the mid sleeve 72 has an inner ledge which abuts the outer shoulder of the second mid sleeve 73 and the second mid sleeve 73 also has an inner ledge which abuts the end gate 74. The gate 74 is pressed against the port 52 by the force of the coil spring 57 compressed by the lower piston 45.

When the motor 1 is trimmed up as described above the lower cylinder 44 is filled with fluid moving the lower piston 45 toward the end of cylinder 19 contacting the piston rod 23. The lower piston 45 will move the retaining ring 75 in the same direction until the retaining ring 75 contacts the shoulder portion of the outer sleeve 71. Continuing in the trim up mode the retaining ring 75 will move the outer sleeve 71 in the same direction until the inner ledge of outer sleeve 71 contacts the outer shoulder of the mid sleeve 72. The mid sleeve 72 will move in the same direction until the inner ledge of the mid sleeve 72 contacts the shoulder of the mid sleeve 73. The mid sleeve 73 will then continue in the same direction until the inner ledge of the mid sleeve 73 contacts the outer shoulder of the end gate 74. During the trim up operation the coil spring 57 forces the end gate 74 against the port 52 thereby sealing the port. The second embodiment is in the fully trimmed up position in FIG. 8.

Continuing the trim mode into the tilt up position will move the end gate 74 away from the port 52 thereby allowing fluid to exit the lower cylinder chamber 44. As with the first embodiment the valve mechanism 55 of the second embodiment allows the piston to travel from fully tilted up to fully tilted down without exposing the soft piston seals 62 or 63 to the potentially damaging edges of a fluid port.

From the foregoing description, it should be readily apparent that the described constructions can permit a very compact hydraulic tilt mechanism for a marine outboard drive and, nevertheless, one in which a valve mechanism can relieve the pressure in a chamber within a hydraulic cylinder depending upon the location of a piston slidably mounted within the cylinder. Of course, those skilled in the art will readily understand that the foregoing description is that of preferred embodiments of the invention, and various changes and modifications may be made without departing from the spirit and scope of the invention, as defined by the appended claims.

What is claimed is:

1. A hydraulic tilt and trim, mechanism for a marine outboard drive adapted to be affixed to one member of the outboard drive and connected to another member of the outboard drive for effecting relative movements of the members of the outboard drive comprising: a hydraulic motor having a cylinder adapted to be affixed to one member of the outboard drive, said cylinder defining a cylinder bore, a piston reciprocating through a stroke length in said cylinder bore and defining first and second fluid chambers within said cylinder bore on opposite sides of said piston, a piston seal carried in an outer perimeter of said piston for forming a seal between said outer perimeter of said piston and said cylinder bore, a piston rod affixed to said piston and extending through said first fluid chamber and one end of said cylinder for connection to another member of the outboard drive, a hydraulic system for selectively pressurizing either of said fluid chambers and relieving the pressure in the remaining of said fluid chambers for effecting a change in the position of said piston in said cylinder, a relief hole extending through said cylinder from said second fluid chamber to an external oil reservoir for relieving the pressure in said second fluid chamber, said relief hole being located so as to not contact said piston seal as said piston reciprocates within said cylinder bore, and a valve mechanism in said second fluid chamber responsive to the position of said piston for mechanically opening or closing said relief hole depending on the location of said piston within said cylinder.

2. A hydraulic tilt and trim mechanism of claim 1, wherein the stroke length defines a trim region and a tilt region.

3. A hydraulic tilt and trim mechanism of claim 2, wherein the valve mechanism opens the relief hole when the piston is located in the tilt region and the valve mechanism closes said relief hole when said piston is located in the trim region.

4. A hydraulic tilt and trim mechanism of claim 3, wherein the valve mechanism comprises a spring, an end gate for sealing the relief hole and a structure for aligning the end gate with the relief hole during the stroke of the piston.

5. A hydraulic tilt and trim mechanism of claim 4, wherein the piston further comprises an upper piston and a lower piston where said upper piston is attached to the piston rod and said lower piston is received in the second fluid chamber and directly operates the valve mechanism.

6. A hydraulic tilt and trim mechanism of claim 5, wherein the upper piston is provided with a shock absorber valve for permitting flow from one side of said upper piston to the other side of said upper piston when an underwater obstacle is struck and a return valve for permitting flow in the opposite direction once the underwater obstacle is cleared.

7. A hydraulic tilt and trim mechanism for a marine outboard drive adapted to be affixed to one member of the outboard drive and connected to another member of the outboard drive for effecting relative movements of the members of the outboard drive comprising: a hydraulic motor having a cylinder adapted to be affixed to one member of the outboard drive, said cylinder defining a cylinder bore, a first piston adapted to be connected to the other member of the outboard drive and reciprocating through a stroke length in said cylinder bore, said first piston defining first and second fluid chambers within said cylinder bore on opposite sides of said first piston, said stroke length defining a trim region and a tilt region, a second, floating piston received in one of said fluid chambers and adapted to abuttingly engage said first piston, a relief hole provided within said one of said fluid chambers and located so as to not contact said pistons as said pistons reciprocate between said trim region and said tilt region, and a valve means located in said one of said fluid chambers and operated by said second piston for selectively opening said relief hole when said pistons are located in said tilt region and closing said relief hole when said pistons are located in said trim region.

8. The hydraulic tilt and trim mechanism of claim 7 wherein the valve mechanism is comprised of a spring element, a valve gate and structure means for aligning said valve gate to seal said relief hole.

* * * * *